US007926218B2

(12) United States Patent
Matthews et al.

(10) Patent No.: US 7,926,218 B2
(45) Date of Patent: Apr. 19, 2011

(54) LASER AIMING APPARATUS USING A ROCKER

(75) Inventors: John W. Matthews, Newport Beach, CA (US); Paul Y. Kim, Santa Ana, CA (US); William D. Wells, Costa Mesa, CA (US)

(73) Assignee: SUREFIRE, LLC, Fountain Valley, CA (US)

( * ) Notice: Subject to any disclaimer, the term of this patent is extended or adjusted under 35 U.S.C. 154(b) by 795 days.

(21) Appl. No.: 11/894,344

(22) Filed: Aug. 20, 2007

(65) Prior Publication Data

US 2008/0202010 A1 Aug. 28, 2008

Related U.S. Application Data

(60) Provisional application No. 60/880,974, filed on Jan. 17, 2007.

(51) Int. Cl.
*F41G 1/00* (2006.01)

(52) U.S. Cl. ..... 42/115; 42/114; 42/117; 42/146

(58) Field of Classification Search ..... 42/114, 42/115, 146, 117
See application file for complete search history.

(56) References Cited

U.S. PATENT DOCUMENTS

| | | | | |
|---|---|---|---|---|
| 4,313,272 | A | 2/1982 | Matthews | |
| 4,348,716 | A | 9/1982 | Storm et al. | |
| 4,856,218 | A * | 8/1989 | Reynolds, Jr. | 42/146 |
| 4,876,816 | A * | 10/1989 | Triplett | 42/115 |
| 4,959,908 | A | 10/1990 | Weyrauch | |
| 5,033,219 | A | 7/1991 | Johnson et al. | |
| 5,253,443 | A | 10/1993 | Baikrich | |
| 5,299,375 | A | 4/1994 | Thummel et al. | |
| 5,323,555 | A | 6/1994 | Jehn | |
| 5,351,429 | A | 10/1994 | Ford | |
| 5,435,091 | A | 7/1995 | Toole et al. | |
| 5,584,569 | A | 12/1996 | Huang | |
| 5,784,823 | A | 7/1998 | Chen | |
| 5,944,410 | A | 8/1999 | Chiou et al. | |
| 6,026,580 | A | 2/2000 | LaRue | |
| 6,276,088 | B1 | 8/2001 | Matthews et al. | |
| 6,345,464 | B1 * | 2/2002 | Kim et al. | 42/114 |
| 6,363,648 | B1 | 4/2002 | Kranich et al. | |
| 6,378,237 | B1 | 4/2002 | Matthews et al. | |
| 6,485,217 | B2 * | 11/2002 | Chien et al. | 403/122 |
| 6,487,809 | B1 | 12/2002 | Gaber | |
| 6,578,311 | B2 | 6/2003 | Danielson et al. | |
| 6,591,536 | B2 | 7/2003 | Houde-Walter et al. | |
| 6,665,331 | B2 * | 12/2003 | Chien | 372/109 |

(Continued)

*Primary Examiner* — Bret Hayes
*Assistant Examiner* — Michael D David
(74) *Attorney, Agent, or Firm* — David Weiss

(57) ABSTRACT

Laser aiming apparatus for accurately and conveniently applying elevation and windage adjustments to a laser beam emanating therefrom. A preferred embodiment includes a housing, which may be adapted to be mounted to a gun; a laser module in the housing and including a sleeve having a laser mounted in the sleeve for emitting a laser beam through a front end thereof along the sleeve's longitudinal axis, the sleeve being pivotally mounted in the housing about a first pivot point on the longitudinal axes of the sleeve and the housing; a rocker pivotally mounted in the housing about a second pivot point on the housing's longitudinal axis and spaced from the first pivot point, the rocker coupled to the sleeve for pivoting the sleeve about the first pivot point; and an adjustment apparatus carried by the housing and engaging the rocker for pivotally adjusting position of the rocker about the second pivot point.

29 Claims, 4 Drawing Sheets

U.S. PATENT DOCUMENTS

| | | | | |
|---|---|---|---|---|
| 6,705,037 | B2 | 3/2004 | Van Kirk | |
| 6,725,819 | B2 | 4/2004 | Yates | |
| 6,793,494 | B2 | 9/2004 | Varshneya et al. | |
| 6,886,287 | B1 | 5/2005 | Bell et al. | |
| 7,076,908 | B2 | 7/2006 | Kim | |
| 7,114,861 | B1 | 10/2006 | Tung | |
| 7,117,624 | B2 | 10/2006 | Kim | |
| 7,331,137 | B2 * | 2/2008 | Hsu | 42/114 |
| 7,472,830 | B2 * | 1/2009 | Danielson | 235/404 |
| 2006/0010760 | A1 | 1/2006 | Perkins et al. | |

* cited by examiner

LASER AIMING APPARATUS USING A ROCKER

CROSS-REFERENCE TO RELATED APPLICATION

This application claims the benefit of U.S. Provisional Patent Application No. 60/880,974, filed Jan. 17, 2007, incorporated in full herein by reference.

BACKGROUND OF THE INVENTION

This invention relates to a laser aiming apparatus, and more particularly to a laser aiming apparatus for accurately and conveniently applying elevation and windage adjustments to a laser beam emanating therefrom.

One type of a laser aiming apparatus, when secured to a gun or firearm, emits a laser beam for providing an aiming mark in the form of a laser spot on a target, the spot representing the placement of a bullet to be fired by the gun at that target. To assure that the position of the laser spot on the target accurately represents the location of bullet impact, the laser aiming apparatus is typically adjusted for effecting elevation and windage compensation such that the path of the emitted laser beam coincides, at the target, with the extended longitudinal axis of the gun barrel from which the bullet is to be fired. A need exists, however, for providing a laser aiming apparatus with an improved compensation mechanism that is compact and is conveniently manipulatible by a user for effecting fine and accurate elevation and windage adjustments.

SUMMARY OF THE INVENTION

Such need is fulfilled by the present invention in which, according to one aspect thereof, a preferred embodiment provides a laser aiming apparatus comprising: a housing which, in one example, is adapted to be mounted to a gun; a laser module in the housing including a sleeve (preferably generally cylindrical in configuration) having a longitudinal axis and a laser mounted in the sleeve for emitting a laser beam through a front end of the sleeve along the sleeve's longitudinal axis, the sleeve pivotally mounted in the housing about a first pivot point on the longitudinal axis; and a rocker pivotally mounted in the housing about a second pivot point spaced from the first pivot point, the rocker coupled to the sleeve for pivoting the sleeve about the first pivot point. In the preferred embodiment, the housing includes a longitudinal axis, and the first and second pivot points are on the housing's longitudinal axis.

An adjustment apparatus is carried by the housing and engages the rocker for pivotally adjusting position of the rocker about the second pivot point. In the preferred embodiment, the laser aiming apparatus includes biasing apparatus disposed in the housing and engaging the rocker for pivotally biasing the rocker about the second pivot point, along with adjustable apparatus disposed in the housing and engaging the rocker for pivotally urging the rocker about the second pivot point against the bias of the biasing apparatus.

According to another aspect of the present invention, a preferred embodiment thereof provides a laser aiming apparatus comprising: a laser module including a sleeve preferably generally cylindrical in configuration) having a longitudinal axis, the sleeve including a forward portion and a rearward portion, the forward portion configured with a generally spherical surface thereabout having a center disposed along the sleeve's longitudinal axis; a housing for the laser module including a front window forwardly of the sleeve's forward portion and a rear wall rearwardly of the sleeve's rearward portion, the forward portion spherical surface being pivotally retained by the housing; a pivot member having a generally spherical surface, the pivot member being fixedly secured to the housing with the pivot member's spherical surface forwardly extending from the housing's rear wall; a rocker pivotally retained on the spherical surface of the pivot member, the rocker having a forward portion engaging the sleeve's rearward portion for urging the sleeve to pivot about the center of the sleeve's spherical surface when the rocker is pivotally displaced about the pivot member. An adjustment apparatus is carried by the housing for pivotally displacing the rocker about the pivot member.

The preferred housing includes a longitudinal axis, and in the preferred embodiment the center of the sleeve's spherical surface and the center of the spherical surface of the pivot member are disposed along the housing's longitudinal axis. The adjustment apparatus, in its preferred embodiment, includes a first translatable member carried by the housing and translatable parallel to the housing's longitudinal axis, the first translatable member engaging the rocker at a location offset from the housing's longitudinal axis, and a first biasing member carried by the housing and engaging the rocker at a location offset from the housing's longitudinal axis and rotationally spaced from the first translatable member, the first translatable member and the first biasing member cooperating with the rocker for pivotally displacing the rocker on the pivot member's spherical surface. The adjustment apparatus further includes, in its preferred embodiment, a second translatable member carried by the housing and translatable parallel to the housing's longitudinal axis, the second translatable member engaging the rocker at a location offset from the housing longitudinal axis and rotationally spaced approximately 90° from the first translatable member, and a second biasing member carried by the housing and engaging the rocker in a location offset from the housing's longitudinal axis and rotationally spaced from the second translatable member, the second translatable member and the second biasing member cooperating with the rocker for pivotally displacing the rocker on the pivot member's spherical surface.

BRIEF DESCRIPTION OF THE DRAWINGS

The novel features believed to be characteristic of the present invention, together with further advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
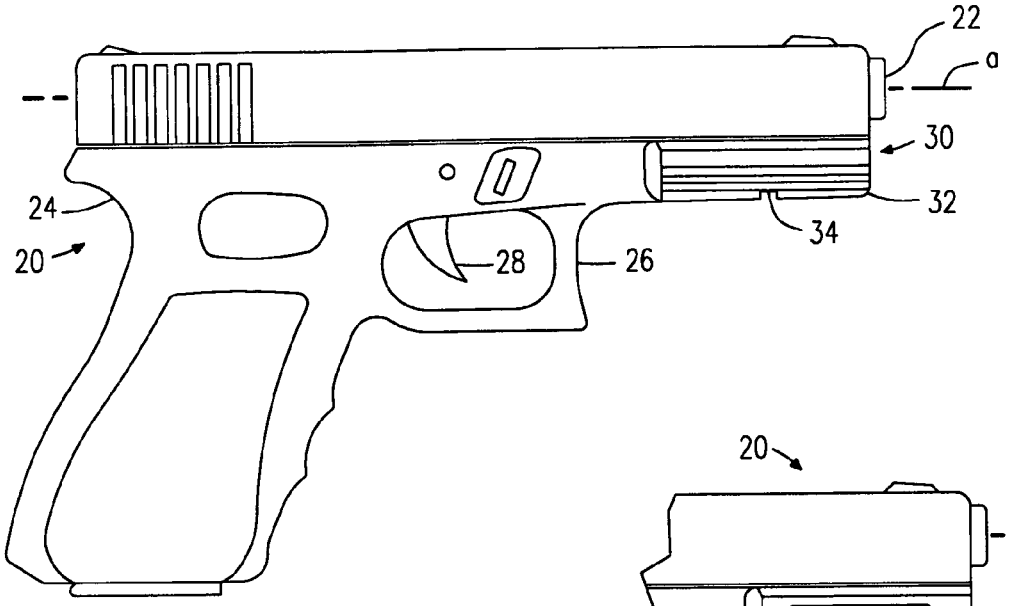
FIG. 1 is a side elevation view of a gun or firearm having a longitudinal rail structure to which may be removably secured an accessory device including a laser aiming apparatus according to the present invention.
Figure 3:
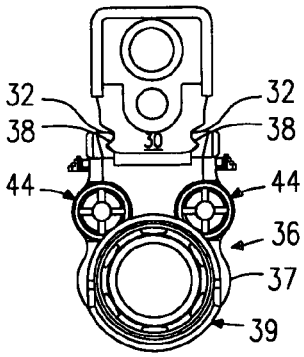
FIG. 3 is a front elevation view of the firearm and secured light with the laser aiming apparatus of FIG. 2.

Turning to FIG. 1, there is illustrated an example of a gun or firearm 20, specifically a handgun having a barrel 22 extending along a longitudinal axis a from the handgun's frame 24 and along which a fired bullet traverses, and a trigger guard 26 in front of the handgun's trigger 28. The handgun 20 includes a longitudinal rail 30 (parallel to the longitudinal axis a) along the frame 24, below the barrel 22 and forwardly of the trigger guard 26. The rail 30 is configured with two longitudinal grooves 32, one along each side of the rail 30 and is further configured with a transverse slot 34 in the bottom surface of the rail 30. As is well known, such rails are intended for mounting an accessory such as a light for illuminating environmental and target areas, the light having a housing configured with a pair of longitudinal tongues (in this respect, see the tongues 38 for a light and laser aiming apparatus 36 as represented in FIG. 3), with such tongues 38 cooperating with the longitudinal grooves 32 mounting the light on the rail. A latch or protuberance on the light housing co-acts with the transverse slot 34 in the rail 30 for retaining the light at a predetermined position along the rail 30.

Although the rail 30 is represented in FIG. 1 as being integral with the frame 24 of the handgun 20, the rail 30 may also be provided as a separate structure that may be removably attached to the handgun beneath the barrel and forwardly of the trigger guard. Such rails for handguns, both integral with the frame and removably attachable to the handgun, as well as lights adapted for being removably attached to such rails as discussed above, are disclosed in U.S. Pat. Nos. 6,276,088 and 6,378,237, both issued to John W. Matthews and Paul Y. Kim and assigned to the assignee of the present invention, which patents are incorporated herein by reference.

Accessory devices according to the present invention, including the preferred combined light/laser aiming embodiment 36 thereof, may be removably secured to firearms other than handguns, as well as to other types of firearms that do not have integral rails but are adapted for having accessory rail mount structures secured thereto. Such rail mount structures are well known in the firearms art, and an example of a rail mount 40 shown in FIG. 4 comprises a series of longitudinally spaced-apart ribs 42 separated by transverse slots, such as a Picatinny rail specified in MIL STD 1913 incorporated herein by reference. The rail structure 40 may be secured to a firearm, for example to a rifle or a shotgun as illustrated in U.S. Pat. No. 7,117,624, issued to Paul Y. Kim and assigned to the assignee of the present invention, which patent is incorporated herein by reference. Other examples of rail structures 40, including Picatinny rails, on other types of firearms are disclosed in U.S. Pat. Nos. 6,508,027 and 6,622,416, both issued to Paul Y. Kim, and U.S. Pat. No. 6,779,288, issued to Paul Y. Kim and John W. Matthews, which patents are assigned to the assignee of the present invention and incorporated herein by reference.

Figure 2:
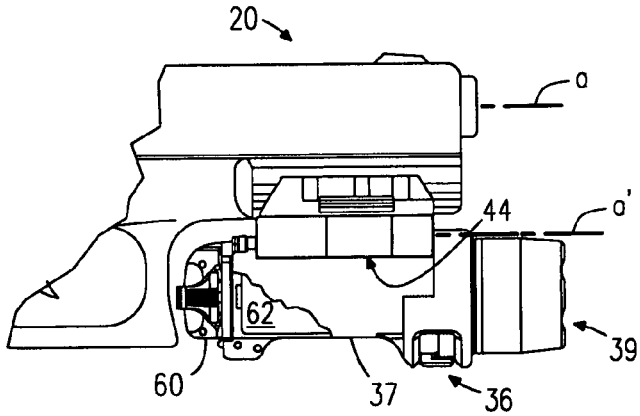
FIG. 2 is a side elevation view of a preferred embodiment of an accessory device including the laser aiming apparatus according to the present invention, specifically a preferred embodiment of a weapon-mountable light (partially broken away) with a preferred embodiment of the laser aiming apparatus, removably secured to the rail structure of the firearm of FIG. 1.
Figure 4:
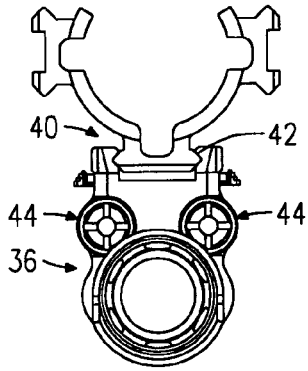
FIG. 4 is a front elevation view of an accessory rail mount for a firearm, to which is mounted the light with the laser aiming apparatus of FIG. 3.
Figure 5:
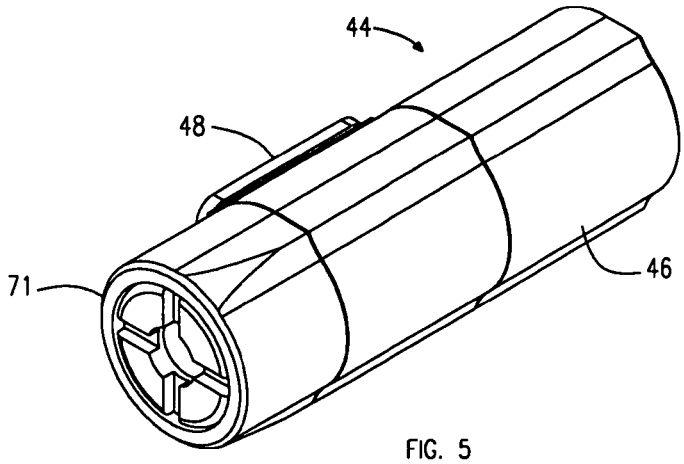
FIG. 5 is a front right-side perspective view of the laser aiming apparatus shown in FIGS. 2-4, specifically the right laser aiming apparatus as viewed in the drawing of FIGS. 3 and 4, shown in increased scale.
Figure 6:
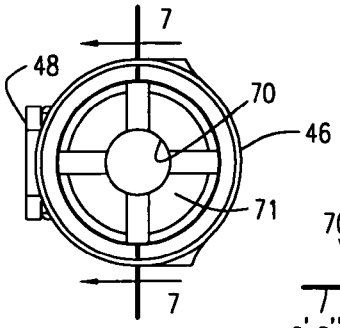
FIG. 6 is a front view of the laser aiming apparatus of FIG. 5.

The present invention is particularly concerned with a laser aiming apparatus for securement to a firearm. One or more units of a preferred embodiment of the laser aiming apparatus 44 may be secured to the firearm-mountable housing 37 of a light 39 (such as the light disclosed in U.S. Pat. No. 7,117,624, incorporated herein by reference) as shown in FIGS. 2-4 herein, or the laser aiming apparatus may be adapted for stand-alone securement to the firearm including direct securement to the rail structure 32 or 40. In either case, the laser aiming apparatus 44 is securable to the firearm and may be adjusted such that the laser aiming apparatus 44 may provide an aiming mark in the form of a light spot on a target by means of a laser beam emanating from the laser aiming apparatus 44.

The preferred embodiment of the laser aiming apparatus 44 is shown in greater detail in FIGS. 5-20, and includes a laser module 50 mounted in a housing 46 having a longitudinal axis a' (such as a generally cylindrical housing 46), secured to the firearm-mountable housing 37 of the light 39 such as by attachment gasket 48. When the combination light/laser aiming apparatus 36 is secured to the firearm 20 as shown in FIGS. 2-4 (or when the housing 46 is otherwise secured to the firearm 20), the longitudinal axis a' of the laser aiming apparatus housing 46 is preferably aligned parallel to the gun's longitudinal axis a.

Figure 7:
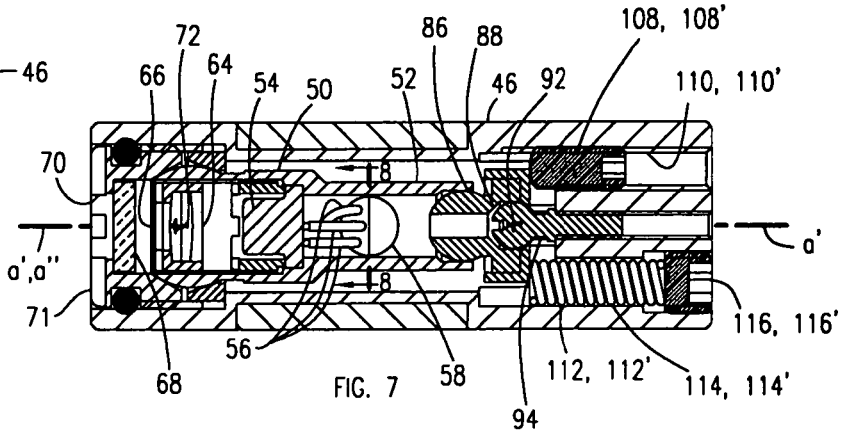
FIG. 7 is a longitudinal cross-sectional view of the laser aiming apparatus of FIGS. 5 and 6, taken along the line 7-7 of FIG. 6 and viewed in the direction of the appended arrows.
Figure 8:
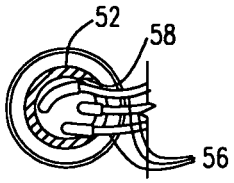
FIG. 8 is a cross-sectional view of a preferred embodiment of a laser module component of the laser aiming apparatus shown in FIG. 7, taken along the line 8-8 and viewed in the direction of the appended arrows.

The laser module 50 includes an elongate casing or sleeve 52 (such as a generally cylindrical sleeve 52) having a longitudinal axis a" which, as represented in FIG. 7, is typically initially coincident with the longitudinal axis a' of the laser aiming apparatus housing 46. A laser diode 54 is mounted within the sleeve 52 along the sleeve's longitudinal axis a", and is in electrical circuit (by means of lead wires 56 extending through a lateral aperture 58 in the sleeve 52, FIGS. 7 and 8) with a multi-function switch arrangement 60 and a battery 62 carried by the light housing 37 (FIG. 2).

The preferred embodiment of the laser module 50 further includes collimating optics such as lens structure 64, mounted to the sleeve 52 along its longitudinal axis a" and forwardly of the laser diode 54, for collimating the light emitted from the laser diode 54 when the switch 60 is in its laser ON condition. The resulting laser beam is directed through a central opening 66 at the forward end of the sleeve 50 along the sleeve's longitudinal axis a", through a lens 68 (which may be a planar disk of transparent material) mounted to the laser aiming assembly housing 46, and finally through a window 70 in the front end 71 of the housing 46 along the housing's longitudinal axis a'.

The laser module sleeve 52 is pivotally mounted within the housing 46 for permitting adjustment of the angular deviation of the sleeve longitudinal axis a" with respect to the housing longitudinal axis a', i.e. for adjusting tilt of the sleeve 52 with respect to the housing 46, both vertically and horizontally, for effecting elevation and windage compensation to the laser beam to assure that the laser dot appearing on the target accurately represents the placement of the bullet to be fired at that target.

Specifically, the laser module sleeve 52 is pivotally mounted to the housing 46 about a first pivot point 72 at a fixed position along the housing's longitudinal axis a' and the sleeve's longitudinal axis a". In the preferred embodiment, such pivotal mounting of the sleeve 52 is implemented by a ball mount including a generally spherically-shaped annular surface 74 about the sleeve 52, preferably in the vicinity of the sleeve's front end 76 (see also FIG. 10). The spherical annular surface 74 is seated between two generally facing ball seat surfaces, such as a generally rearwardly-facing conical surface 78 of the front mount component 80 (see also FIGS. 11 and 12) and a generally forwardly-facing conical surface 82 of a pivot ring 84 (see also FIGS. 13 and 14), the front mount 80 and the pivot ring 84 being mounted in the housing 46, preferably in the vicinity of that housing's front end 71.

A portion of the sleeve 52 in the vicinity of its rear end 86 is mounted in the housing 46 for retainably pivoting the sleeve 52 about the first pivot point 72. A generally spherical pivot member 88 is secured to the housing 46 with the pivot member's spherical center situated on the housing's longitudinal axis a' and comprising a second pivot point 92. A rocker 90 is pivotally retained on the spherical pivot member for being pivoted about the second pivot point 92.

In the preferred embodiment, the spherical pivot member 88 comprises the headed end of a threaded pin 94 threadedly secured along the housing's longitudinal axis a' to a rear wall 96 of the housing 46, with the pin's spherical head 88 situated rearwardly of the rear end 86 of the sleeve 52. The rocker 90 may be constructed of a rear rocker component 98 (see also FIGS. 15 and 16) and forward rocker component 100 (see also FIGS. 17 and 18), the assembled components 98, 100 having respective central bores 102, 104 configured for embracing the spherical pivot member 88 such that the assembled rocker is pivotally retained by the spherical pivot member 88 about the second pivot point 92.

The forward portion 106 of the rocker 90 (i.e., the forward portion 106 of the forward rocker component 100) is configured with a spherical surface. A portion of the sleeve 52 in the vicinity of its rear end 86 embraces the rocker spherical surface 106. In the preferred embodiment, the rocker spherical surface 106 is in contact engagement with the interior surface of the sleeve 52 in the vicinity of the sleeve's rear end 86.

Figure 9:
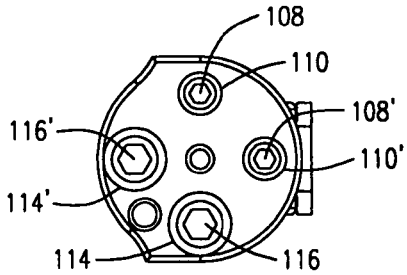
FIG. 9 is a rear end view of the laser aiming apparatus of FIG. 5.

As represented in FIGS. 7 and 9, a pair of adjustable devices (such as set screws 108, 108') are threadably secured to threaded bores 110, 110' in the housing's rear wall 96. The bores 110, 110' are preferably parallel to and laterally spaced from the housing's longitudinal axis a', the bores 110, 110' with their inserted respective set screws 108, 108' being laterally spaced approximately 90° apart and with the set screws front ends in contact engagement with the rear surface of the rocker 90. A pair of biasing devices (such as helical springs 112, 112') are respectively situated in bores 114, 114' in the housing's rear wall 96. The bores 114, 114' are parallel to and spaced from the housing's longitudinal axis a', and the springs 112, 112' are respectively retained in such bores by threaded plugs 116, 116'. The bore 114 (and hence the spring 112) is laterally spaced approximately 180° from the set screw 108, and the bore 114' (and hence the spring 112') is laterally spaced approximately 180° from the set screw 108'. The forward ends of the springs 112, 112' are in contact engagement with the rear surface of the rocker 90. The springs 112, 112' are maintained in compression so that the front ends of the screws 108, 108' are maintained in contact engagement with the rocker 90 against the bias of the springs 112, 112'.

In the discussion of the paragraph immediately above, it should be noted that FIG. 7 is a vertically cut longitudinal cross-section of the laser aiming apparatus 44 including elements with unprimed reference numerals 108-116, and that a horizontally cut cross-section of the laser aiming apparatus 44 would be similar to the vertical cross-section except that the unprimed reference numerals 108-116 would be replaced by the primed reference numerals 108'-116'. Similarly, with respect to FIGS. 10, 19 and 20, the set screw 108 and spring 112 are associated with vertical adjustments to the laser module 50, while the set screw 108' and spring 112' are associated with horizontal adjustments to the laser module 50, as further described below.

Figure 10:
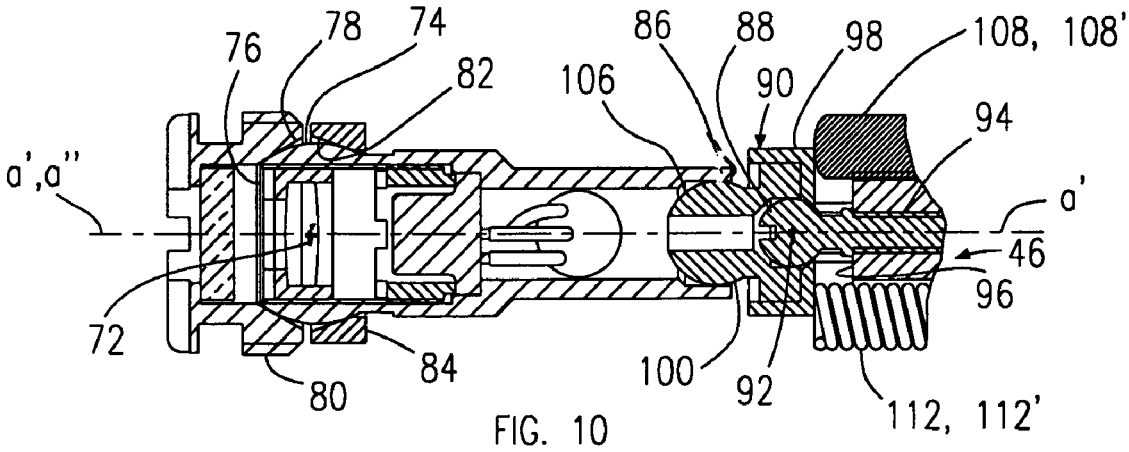
FIG. 10 is a fragmented portion of the laser aiming apparatus of FIG. 7, shown in increased scale and with its housing mostly removed for clarity of description.
Figure 11:
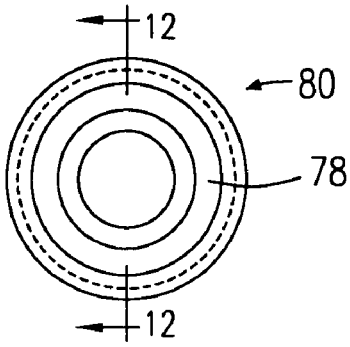
FIG. 11 is a rear view of a preferred embodiment of a front mount component included in the laser aiming apparatus of FIG. 7, shown in the same scale as in FIG. 10.
Figure 12:
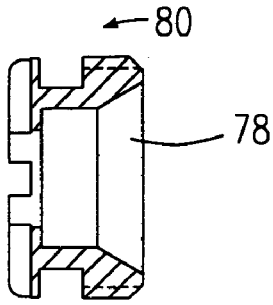
FIG. 12 is a cross-sectional view of the front mount of FIG. 11, taken along the line 12-12 and viewed in the direction of the appended arrows.
Figure 13:
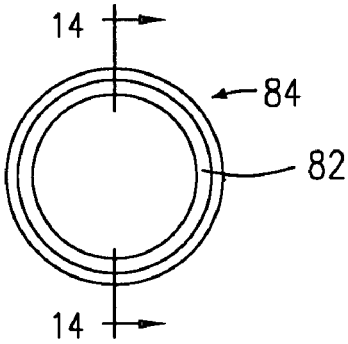
FIG. 13 is a front view of a pivot ring included in the laser aiming apparatus of FIGS. 7 and 10.
Figure 14:
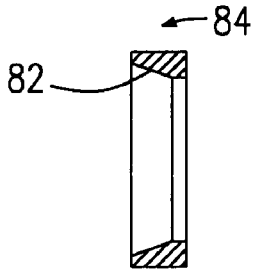
FIG. 14 is a cross-sectional view of the pivot ring of FIG. 13, taken along the line 14-14 and viewed in the direction of the appended arrows.
Figure 15:
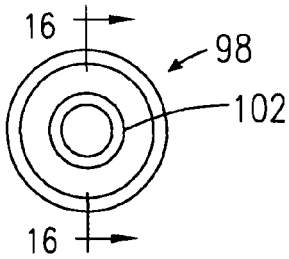
FIG. 15 is a front view of a rear component of a rocker device included in the laser aiming apparatus of FIGS. 7 and 10.
Figure 16:
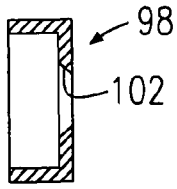
FIG. 16 is a cross-sectional view of the rear rocker component of FIG. 15, taken along the line 16-16 and viewed in the direction of the appended arrows.
Figure 17:
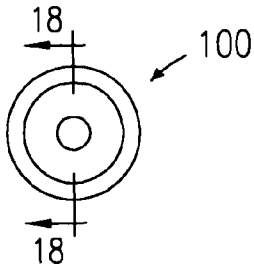
FIG. 17 is a front view of a forward component of the rocker device included in the laser aiming apparatus of FIGS. 7 and 10.
Figure 18:
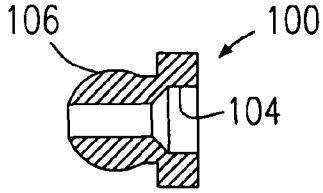
FIG. 18 is a cross-sectional view of the forward rocker component of FIG. 17, taken along the line 18-18 and viewed in the direction of the appended arrows.

The rear ends of the set screws 108, 108' are accessible at the rear end of the housing 46 as shown in FIGS. 7 and 9, for permitting a user to forwardly and rearwardly translate the set screws 108, 108' parallel to the housing's longitudinal axis a', by use of a tool such as an Allen wrench. The initial orientation of the laser module's longitudinal axis a" with respect to the housing's longitudinal axis a' is shown in FIGS. 7 and 10, where the axes a' and a" coincide with one another. The laser aiming apparatus 44 may be secured to the firearm 20 with the housing longitudinal axis a' substantially parallel to the firearm longitudinal axis a, such as by securing the light 36 with included laser aiming apparatus 44 to the firearm 20 as previously described in connection with FIGS. 1-4.

Figure 19:
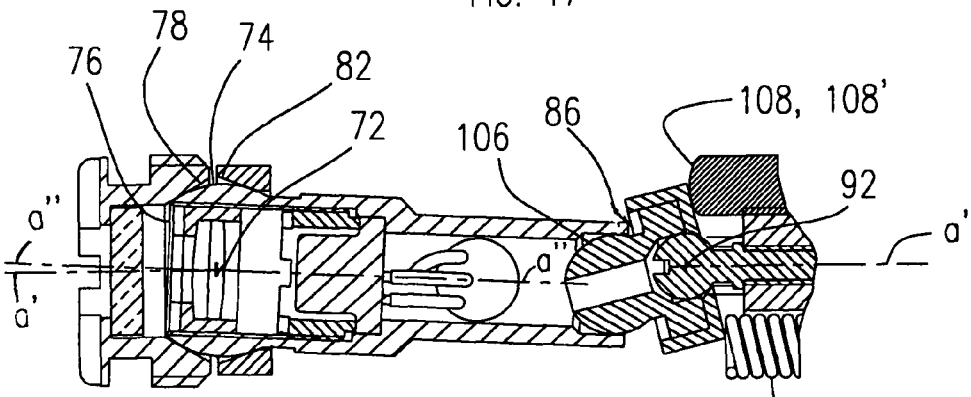
FIG. 19 is similar to FIG. 10, in which one example of a laser beam adjustment is illustrated.
Figure 20:
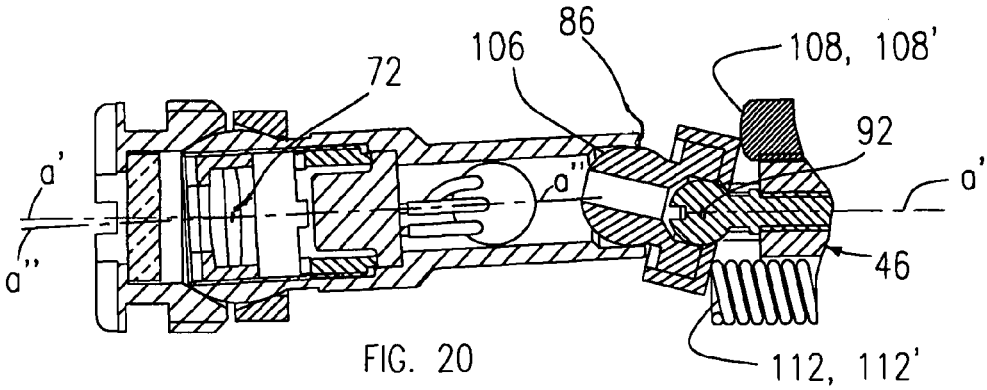
FIG. 20 is similar to FIG. 10, in which another example of a laser beam adjustment is illustrated.

When it is desired to provide an elevation adjustment to the laser module 50 and hence to the laser beam emitted therefrom, the user may cause the elevation adjustment set screw 108 to be forwardly translated with respect to the housing 46 as shown in FIG. 19, or rearwardly translated with respect to the housing 46 as shown in FIG. 20. When forwardly translated (FIG. 19), the forward end of the set screw 108 urges the rocker 90 to pivot about the second pivot point 92 against the bias of the spring 112, counterclockwise as viewed in FIG. 19. The contact engagement of the rocker's spherical surface 106 with the rear end portion of the module sleeve 52 urges the sleeve's rear end 86 downwardly, thereby causing the sleeve 52 to clockwise pivot in the ball mount 74, 78, 82 about the first pivot point 72. The laser beam, which follows the laser module's longitudinal axis a", correspondingly pivots about the first pivot point 72, providing an upward elevation adjustment to the laser beam.

When the set screw 108 is rearwardly translated with respect to the housing 46 as shown in FIG. 20, the spring 112 pivotally biases the rocker 90 against the forward end of the set screw 108, the rocker 90 pivoting about the second pivot point 92, clockwise as viewed in FIG. 20. The contact engagement of the rocker's spherical surface 106 with the rear end portion of the module sleeve 52 urges the sleeve's rear end 86 upwardly, thereby causing the sleeve 52 to counterclockwise pivot in the ball mount 74, 78, 82 about the first pivot point 72. The laser beam, which follows the laser module's longitudinal axis a", correspondingly pivots about the first pivot point 72, providing a downward elevation adjustment to the beam.

When it is desired to provide a windage adjustment to the laser module 50 and hence to the laser beam emitted therefrom, the user may cause the windage adjustment set screw 108' to be forwardly translated with respect to the housing 46 as shown in FIG. 19, or rearwardly translated with respect to the housing 46 as shown in FIG. 20. When the set screw 108' is forwardly translated (FIG. 19), the forward end of the set screw 108' urges the rocker 90 to pivot about the second pivot point 92 against the bias of the spring 112', counterclockwise as viewed in FIG. 19. The contact engagement of the rocker's spherical surface 106 with the rear end portion of the module sleeve 52 urges the sleeve's rear end 86 in a first horizontal lateral direction (say to the left, downwardly as viewed in FIG. 19), thereby causing the sleeve 52 to clockwise pivot in the ball mount 74, 78, 82 about the first pivot point 72. The laser beam, which follows the laser module's longitudinal axis a", correspondingly pivots about the first pivot point 72, providing a right windage adjustment to the beam.

When the windage set screw 108' is rearwardly translated (FIG. 20), the spring 112' pivotally biases the rocker 90 against the forward end of the set screw 108', the rocker 90 pivoting about the second pivot point 92 clockwise as viewed in FIG. 20. The contact engagement of the rocker's spherical surface 106 with the rear end portion of the module sleeve 52 urges the sleeve's rear end 86 in a second horizontal lateral direction opposite the first horizontal lateral direction (say to the right, upwardly as viewed in the drawing of FIG. 20), thereby causing the sleeve 52 to counterclockwise pivot in the ball mount 74, 78, 82 about the first pivot point 72. The laser beam, which follows the laser module's longitudinal axis a", correspondingly pivots about the first pivot point 72, providing a left windage adjustment to the beam.

It may be appreciated that, since the first pivot point 72 is situated in the vicinity of the forward end of the sleeve 52, an incremental translation of the set screw 108 or 108' causes a much smaller increment of elevation or windage adjustment of the sleeve 52 and hence of the laser beam represented by the laser module's longitudinal axis a".

The laser diode 54 may be of conventional type typically used for producing laser aiming beams for firearms. Preferably, one laser diode for generating a laser beam resulting in a visible dot (which may, for example, be red or green) on the target may be installed in one of the laser aiming units 44 shown in FIG. 3, while another laser diode for generating an infrared laser beam (resulting in an infrared laser dot on the target not visible to the naked eye) may be installed in the other one of the laser aiming units 44 shown in FIG. 3.

Thus, there has been described a preferred embodiment of a laser aiming apparatus including provision for conveniently effecting fine and accurate elevation and windage adjustments. The laser aiming apparatus according to the preferred embodiment may be mounted to a gun, although it may be appreciated that such laser aiming apparatus may be used in applications not including a gun. Other embodiments of the present invention, and variations of the embodiment presented herein, may be developed without departing from the essential characteristics thereof. Accordingly, the invention should be limited only by the scope of the claims listed below.

We claim:

1. Laser aiming apparatus, comprising:

a housing;

a laser module in said housing, said laser module including a sleeve having a longitudinal axis and a laser mounted in said sleeve for emitting a laser beam through a front end of said sleeve along said longitudinal axis, said sleeve pivotally mounted in said housing about a first pivot point on said longitudinal axis; and a rocker pivotally mounted in said housing about a second pivot point spaced from said first pivot point, said rocker coupled to said sleeve for pivoting said sleeve about said first pivot point.

2. The apparatus according to claim 1, wherein:

said housing is adapted to be mounted to a gun.

3. The apparatus according to claim 1, wherein:

said sleeve is generally cylindrical.

4. The apparatus according to claim 1, including:

an adjustment apparatus carried by said housing and engaging said rocker for pivotally adjusting position of said rocker about said second pivot point.

5. The apparatus according to claim 1, wherein:

said housing includes a longitudinal axis; and said second pivot point is on said longitudinal axis of said housing.

6. The apparatus according to claim 5, wherein:

said first pivot point is on said longitudinal axis of said housing.

7. The apparatus according to claim 6, including:

an adjustment apparatus carried by said housing and engaging said rocker for pivotally adjusting position of said rocker about said second pivot point.

8. The apparatus according to claim 1, wherein:

said housing includes a longitudinal axis; and said first pivot point is on said longitudinal axis of said housing.

9. The apparatus according to claim 1, including:

biasing apparatus disposed in said housing and engaging said rocker for pivotally biasing said rocker about said second pivot point; and an adjustable apparatus disposed in said housing and engaging said rocker for pivotally urging said rocker about said second pivot point against the bias of said biasing apparatus.

10. The apparatus according to claim 9, wherein:

said adjustable apparatus is threadably disposed in said housing.

11. The apparatus according to claim 9, wherein:

said housing includes a longitudinal axis; and said adjustable apparatus includes two elongate screw members threadedly disposed in said housing and aligned substantially parallel to said longitudinal axis of said housing, said elongate screw members rotationally spaced apart with respect to said longitudinal axis of said housing.

12. The apparatus according to claim 11, wherein:

said elongate screw members are rotationally spaced apart by approximately 90° with respect to said longitudinal axis of said housing.

13. The apparatus according to claim 12, wherein:

said biasing apparatus includes two springs disposed in said housing and respectively rotationally spaced apart from said two elongate screw members by approximately 180° with respect to said longitudinal axis of said housing.

14. The laser aiming apparatus according to claim 1, wherein:

said sleeve includes a forward portion and a rearward portion, said forward portion configured with a generally spherical surface thereabout pivotally retained by said housing about said first pivot point;

said housing includes a front window forwardly of said forward portion of said sleeve and a rear wall rearwardly of said rearward portion of said sleeve;

a pivot member is fixedly secured to said housing, said pivot member including a generally spherical surface forwardly extending from said rear wall about said second pivot point; and said rocker is pivotally retained on said spherical surface of said pivot member, said rocker having a forward portion engaging said rearward portion of said sleeve for urging said sleeve to pivot about said first pivot point when said rocker is pivotally displaced about said second pivot point.

15. The apparatus according to claim 14, including:

an adjustment apparatus carried by said housing and engaging said rocker for pivotally adjusting position of said rocker about said second pivot point.

16. The apparatus according to claim 14, wherein:

said housing includes a longitudinal axis; and said second pivot point is on said longitudinal axis of said housing.

17. The apparatus according to claim 16, wherein:

said first pivot point is on said longitudinal axis of said housing.

18. The apparatus according to claim 17, including:

an adjustment apparatus carried by said housing and engaging said rocker for pivotally adjusting position of said rocker about said second pivot point.

19. The apparatus according to claim 14, wherein:

said housing includes a longitudinal axis; and said first pivot point is on said longitudinal axis of said housing.

20. The apparatus according to claim 14, including:

biasing apparatus disposed in said housing and engaging said rocker for pivotally biasing said rocker about said second pivot point; and an adjustable apparatus disposed in said housing and engaging said rocker for pivotally urging said rocker about said second pivot point against the bias of said biasing apparatus.

21. The apparatus according to claim 20, wherein:

said housing includes a longitudinal axis; and said adjustable apparatus includes two elongate screw members threadedly disposed in said housing and aligned substantially parallel to said longitudinal axis of said housing, said elongate screw members rotationally spaced apart with respect to said longitudinal axis of said housing.

22. The apparatus according to claim 14, wherein: said housing is adapted to be mounted to a gun.

23. The apparatus according to claim 14, wherein:

said sleeve is generally cylindrical.

24. The apparatus according to claim 14, wherein said housing includes a longitudinal axis, and including:

a first translatable member carried by said housing and translatable parallel to said longitudinal axis of said housing, said first translatable member engaging said rocker at a location offset from said longitudinal axis of said housing, and a first biasing member carried by said housing and engaging said rocker at a location offset from said longitudinal axis of said housing and rotationally spaced from said first translatable member, said first translatable member and said first biasing member cooperating with said rocker for pivotally displacing said rocker on said generally spherical surface of said pivot member; and a second translatable member carried by said housing and translatable parallel to said longitudinal axis of said housing, said second translatable member engaging said rocker at a location offset from said longitudinal axis of said housing and rotationally spaced from said first translatable member, and a second biasing member carried by said housing and engaging said rocker at a location offset from said longitudinal axis of said housing and rotationally spaced from said second translatable member, said second translatable member and said second biasing member cooperating with said rocker for pivotally displacing said rocker on said generally spherical surface of said pivot member.

25. The apparatus according to claim 24, wherein:

said second translatable member is rotationally spaced from said first translatable member by approximately 90°.

26. The apparatus according to claim 24, wherein:

said first biasing member is rotationally spaced from said first translatable member by approximately 180°, and said second biasing member is rotationally spaced from said second translatable member by approximately 180°.

27. The apparatus according to claim 1, wherein said housing includes a longitudinal axis, and including:

a first translatable member carried by said housing and translatable parallel to said longitudinal axis of said housing, said first translatable member engaging said rocker at a location offset from said longitudinal axis of said housing, and a first biasing member carried by said housing and engaging said rocker at a location offset from said longitudinal axis of said housing and rotationally spaced from said first translatable member, said first translatable member and said first biasing member cooperating with said rocker for pivotally displacing said rocker about said pivot point; and a second translatable member carried by said housing and translatable parallel to said longitudinal axis of said housing, said second translatable member engaging said rocker at a location offset from said longitudinal axis of said housing and rotationally spaced from said first translatable member, and a second biasing member carried by said housing and engaging said rocker at a location offset from said longitudinal axis of said housing and rotationally spaced from said second translatable member, said second translatable member and said second biasing member cooperating with said rocker for pivotally displacing said rocker about said pivot point.

28. The apparatus according to claim 27, wherein:

said second translatable member is rotationally spaced from said first translatable member by approximately 90°.

29. The apparatus according to claim 28, wherein:

said first biasing member is rotationally spaced from said first translatable member by approximately 180, and said second biasing member is rotationally spaced from said second translatable member by approximately 180°.

* * * * *